US008100262B2

(12) United States Patent
Jones

(10) Patent No.: US 8,100,262 B2
(45) Date of Patent: Jan. 24, 2012

(54) BLISTER PACK SECONDARY PACKAGE

(75) Inventor: Marty Jones, Graham, NC (US)

(73) Assignee: MeadWestvaco Corporation, Richmond, VA (US)

( * ) Notice: Subject to any disclaimer, the term of this patent is extended or adjusted under 35 U.S.C. 154(b) by 0 days.

(21) Appl. No.: 12/517,745

(22) PCT Filed: Dec. 3, 2007

(86) PCT No.: PCT/US2007/086278

§ 371 (c)(1),
(2), (4) Date: Nov. 19, 2009

(87) PCT Pub. No.: WO2008/070622

PCT Pub. Date: Jun. 12, 2008

(65) Prior Publication Data

US 2010/0096292 A1 Apr. 22, 2010

Related U.S. Application Data

(60) Provisional application No. 60/869,004, filed on Dec. 7, 2006.

(51) Int. Cl.
*B65D 83/04* (2006.01)

(52) U.S. Cl. ..... 206/472; 206/468; 206/528

(58) Field of Classification Search ..... 206/462, 206/468, 467, 531, 532, 538, 528, 472
See application file for complete search history.

(56) References Cited

U.S. PATENT DOCUMENTS

| | | | | |
|---|---|---|---|---|
| 3,137,435 | A | 6/1964 | Myers | |
| 3,382,972 | A * | 5/1968 | Phipps | 206/468 |
| 3,467,248 | A * | 9/1969 | Makowicki | 206/465 |
| 4,463,893 | A * | 8/1984 | Brunone et al. | 229/102 |
| 4,485,920 | A * | 12/1984 | Skylvik | 206/468 |
| 4,951,404 | A * | 8/1990 | Lithwick | 40/124.06 |
| 5,224,599 | A * | 7/1993 | Uchida | 206/308.3 |
| 5,297,679 | A * | 3/1994 | Rondone et al. | 206/468 |
| 6,047,829 | A | 4/2000 | Johnstone et al. | |
| 6,230,893 | B1 | 5/2001 | Karow | |
| 6,412,636 | B1 | 7/2002 | Jones et al. | |
| 6,726,015 | B2 * | 4/2004 | Hulick | 206/531 |
| 6,752,272 | B2 | 6/2004 | Jones et al. | |

FOREIGN PATENT DOCUMENTS

| | | |
|---|---|---|
| DE | 29921100 | 3/2000 |
| WO | WO2004019854 | 3/2004 |

* cited by examiner

*Primary Examiner* — David Fidei
(74) *Attorney, Agent, or Firm* — MWV Intellectual Property Group

(57) ABSTRACT

A blank (10) for forming a secondary package without a heat-seal process is disclosed. The secondary package can be an inner slide card configured to receive one or more blister packs (51). A pocket opening (30) can be formed in one panel (14) of the blank (10). Receiving portions (44) can be formed on one or more panels. A blister pack (51) can be inserted into the secondary package through the pocket opening (30). The receiving portions (44) can mechanically interact with edges (56) of a blister pack (51) to retain the blister pack (51) in a desired position. The exit regions of an inserted blister pack (51) can be aligned with gates (40) formed in a panel (12) of the secondary package. When the blister pack (51) is in the proper orientation relative to the secondary package, the blister pack (51) can be locked in place mechanically, glued in place, or both.

3 Claims, 4 Drawing Sheets

BLISTER PACK SECONDARY PACKAGE

RELATED APPLICATION

This application claims priority to U.S. Provisional Patent Application No. 60/869,004, filed Dec. 7, 2006, the entirety of which is hereby incorporated by reference.

TECHNICAL FIELD

The present disclosure relates generally to packaging. More specifically, the present disclosure is directed to a secondary package for a blister pack.

BACKGROUND

Medications in the form of tablets, pills, capsules, gel tablets, and the like, are typically placed and sealed within a primary package, such as a conventional blister pack. Frequently, the primary package is then placed into a secondary package, such as a traditional box or carton, for eventual purchase and consumption of the medication by the end-user. It is also known to enhance the functionality and usefulness of a primary and/or secondary package. One example of such an enhanced package, which includes child resistant features, is Applicant's DOSEPAK® brand line of consumer products packaging.

In some embodiments, the DOSEPAK® brand line of consumer products packaging includes a blister pack secured within, or to, an inner slide card that is itself placed in an outer sleeve. Features and elements found on both the inner slide card and outer sleeve allow the inner card to be releasably locked within the outer sleeve. In these embodiments, the result is a child-resistant package that can still be manipulated with relative ease by an end-user with limited dexterity or strength. The DOSEPAK® brand line of consumer products packaging has found wide acceptance, particularly in the healthcare industry where blister packs are prevalent. These and other features of the DOSEPAK® brand line can be more clearly appreciated by referring to U.S. Pat. Nos. 6,047,829; 6,230,893B1; 6,412,636B1, and 6,752,272B1.

The process of filling and shipping the blister packs, with or without secondary packaging, is typically the responsibility of the so-called "filler"—usually the manufacturer who produces the items held by the blisters or another party contracted for that service. Fillers that secure blister packs to secondary packages such as a card typically so do using a heat-seal process. As understood by those skilled in the art, heat-sealing includes mounting a blister pack to an adhesive coated paperboard substrate, and applying heat so that the blister pack is secured to the paperboard or trapped between layers of paperboard. Examples of coated paperboard substrates used in heat-sealing include Applicant's EASYSEAL™ and EASYSEAL PLUS™ brand coated paperboard products.

With the present disclosure, the Applicant seeks to create a need and a market for a secure secondary package that does not require a heat-sealing process.

SUMMARY

A blank for forming a secondary package without a heat-seal process is disclosed. The secondary package can be an inner slide card configured to receive one or more blister packs. The secondary package blank can be formed from one piece of material, or can be assembled from several separate and distinct pieces of material. The blank can include several panels. A pocket opening can be formed in one of the panels. Receiving portions can be formed on one or more of the panels. The receiving portions can be formed by cutting the substrate to a desired configuration, or by adding other material, such as, adhesive tape or glue. After a blank is erected to form a blister pack secondary package, a blister pack can be inserted into the secondary package through the pocket opening formed in one of the panels. In some embodiments, the receiving portions mechanically interact with edges of the blister pack to retain the blister pack in a desired position. The exit regions of an inserted blister pack can be aligned with gates formed in a panel of the secondary package. When the blister pack is in the proper orientation relative to the secondary package, the blister pack can be locked in place mechanically, glued in place, or both. No heat sealing is required to form the secondary package, or to hold the blister pack in the desired orientation.

Accordingly, an embodiment of the disclosure includes a blank for forming a blister pack secondary package. The blank includes a base panel and a top panel with at least one blister receiving aperture. A means for connecting can be located on either or both of the base panel and the top panel. The blank also includes at least one receiving flange proximate to the receiving aperture. A blister pack receiving pocket is defined, at least in part, by the means for connecting and the receiving aperture when the top panel is connected to the base panel.

According to an aspect of the disclosure, the blister receiving aperture includes an insert edge.

According to another aspect of the disclosure, the receiving flange is configured to receive a blister flange.

Another embodiment of the disclosure includes a package for receiving and holding a blister pack. The package of the blister pack includes a secondary package. The secondary package includes a base panel, and a top panel with at least one blister receiving aperture. A means for securing can be located on either or both of the base panel and the top panel. The package can also include at least one receiving flange proximate to the blister receiving aperture and a blister pack receiving pocket configured to receive and hold a blister pack. The blister pack receiving pocket is defined, at least in part, by the means for connecting and the blister receiving aperture.

According to another aspect of the disclosure, the blister receiving pocket is further defined by a pocket opening.

According to another aspect of the disclosure, the blister pack further includes a leading edge connected to one of said top panel and said base panel.

These and other features will be further described with reference to the attached drawings.

DESCRIPTION

As required, detailed embodiments of the present disclosure are disclosed herein. It must be understood that the disclosed embodiments are merely exemplary of the disclosure that may be embodied in various and alternative forms, and combinations thereof. As used herein, the word "exemplary" is used expansively to refer to embodiments that serve as an illustration, specimen, model or pattern. The figures are not necessarily to scale and some features may be exaggerated or minimized to show details of particular components. In other instances, well-known components, systems, materials or methods have not been described in detail in order to avoid obscuring the present disclosure. Therefore, specific structural and functional details disclosed herein are not to be interpreted as limiting, but merely as a basis for the claims and as a representative basis for teaching one skilled in the art to variously employ the present disclosure.

Figure 1:
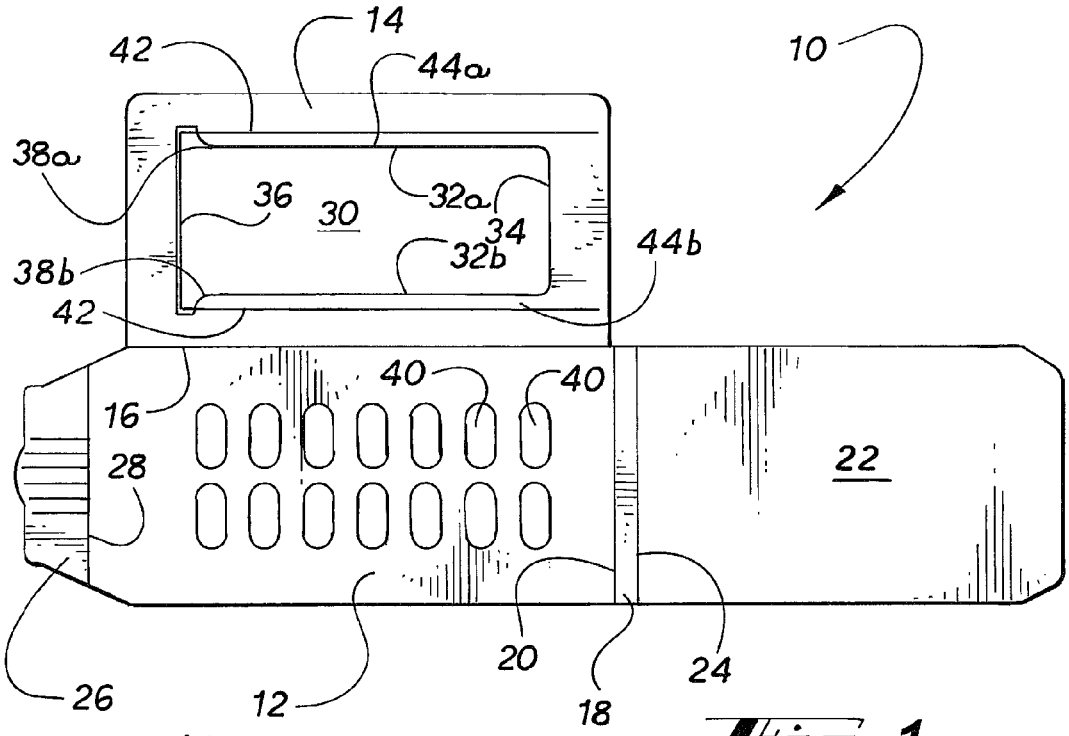
FIG. 1 is a plan view of a blank, according to an exemplary embodiment of the present disclosure.

Referring now to the figures, wherein similar elements are designated with similar numbers, FIG. 1 illustrates an exemplary blank 10 for forming a secondary package, in this case an inner slide card configured to receive a blister pack. Further, the illustrated blanks are shown and described in terms of unitary blanks but it is contemplated that the blanks of the present disclosure can be constructed and erected from separate and/or discrete panels that are joined or assembled together. The panels can be joined together using any suitable adhesives, tapes, labels, hot melt. Alternatively, the pieces can be made using EASYSEAL PLUS™ brand paperboard. As all the various embodiments of blister packs, including those with various types of backings such as paper and/or foil, and those made of various materials such as plastic, aluminum, and paper, and those with various types of child-resistant features, and combinations of these, are all well known to those skilled in the art and the structure or function of the blister packs referenced herein will not be further described.

In addition, the illustrated slide card is configured to be releasably received by an outer sleeve, such as those taught in various pending U.S. and foreign patent applications and patents related to the DOSEPAK® brand family of products. Accordingly, the relationship between the illustrated slide card and an outer sleeve will not be further taught herein. Also the materials used as the substrate of the blank 10 can be selected from among any of the well-known materials or combinations of materials and will not be further taught herein.

Continuing with reference to FIG. 1, the illustrated blank 10 for forming a secondary package includes a base panel 12, a top panel 14 foldably attached to the base panel 12 along a first fold line 16, a spine 18 foldably attached to the base panel 12 along a second fold line 20, a cover panel 22 foldably attached to the spine 18 along a third fold line 24, and a locking panel 26 foldably attached to the base panel 12 along a fourth fold line 28. In an alternative embodiment, not illustrated here, the secondary package 10 does not include the locking panel 26. In still another alternative embodiment, not illustrated here, the secondary package 10 does not include the locking panel 26, top cover 22, or spine 18 or their associated fold lines 20, 24, and 28.

The top panel 14 further includes a blister pack receiving aperture 30. The perimeter of the illustrated receiving aperture 30 is generally the same shape as the perimeter of the top panel 14, being defined by opposing side edges 32*a*, 32*b*, an end edge 34, and an insert edge 36. The insert edge 36 begins and terminates at opposing, outwardly turning—with respect to the void that is the receiving aperture 30—radius cuts 38*a*, 38*b*. In the illustrated embodiment the receiving aperture 30 perimeter is slightly larger than the outside perimeter of the group of gates 40 located on the base panel 12. The gates 40 are provided to impede removal of an item from a blister of a blister pack. Here, as illustrated, each gate 40 is defined by perforations. The perforations that define a gate 40 can be severed, and therefore, a gate 40 is removed, before or in conjunction with removing an item from a respective blister of a blister pack. In alternative embodiments, the gates 40 are apertures and do not further impede the removal of an item from a blister.

In erecting the illustrated blank 10 to form a slide card, one or more areas of adhesive 42 initially can be located on the top panel 14 proximate to the respective side edges 32*a*, 32*b*, to connect the top panel 14 to the base panel 12. When connecting the respective panels 12, 14, the areas on the top panel 14 between the respective side edges 32*a*, 32*b* and means for connecting or means for securing 42 are not connected to the base panel 12, thereby creating receiving flanges 44*a*, 44*b* as will be further described with reference to FIGS. 3A-3D. While the illustrated blank 10 includes two areas of adhesive, it should be understood that any means for connecting or means for securing 42 can be used to connect the top panel 14 to the base panel 12. The means for connecting or means for securing 42 can include, but are not limited to, chemical connecting products such as cold adhesive, hot adhesive, epoxy, combinations thereof, and the like, as well as mechanical connecting products such as staples, stitching, punches, rivets, combinations thereof, and the like, as well as chemical/mechanical connecting products such as welding, single face or double face tape, combinations thereof, and the like. In some embodiments, an area seal using EASYSEAL PLUS™ paperboard is employed to form and seal the blank. In alternative embodiments, the means for connecting 42 also can be located proximate the end edge 34 and/or the leading edge 36. In alternative embodiments, the adhesive 42 is initially located on the base panel 12.

Figure 2:
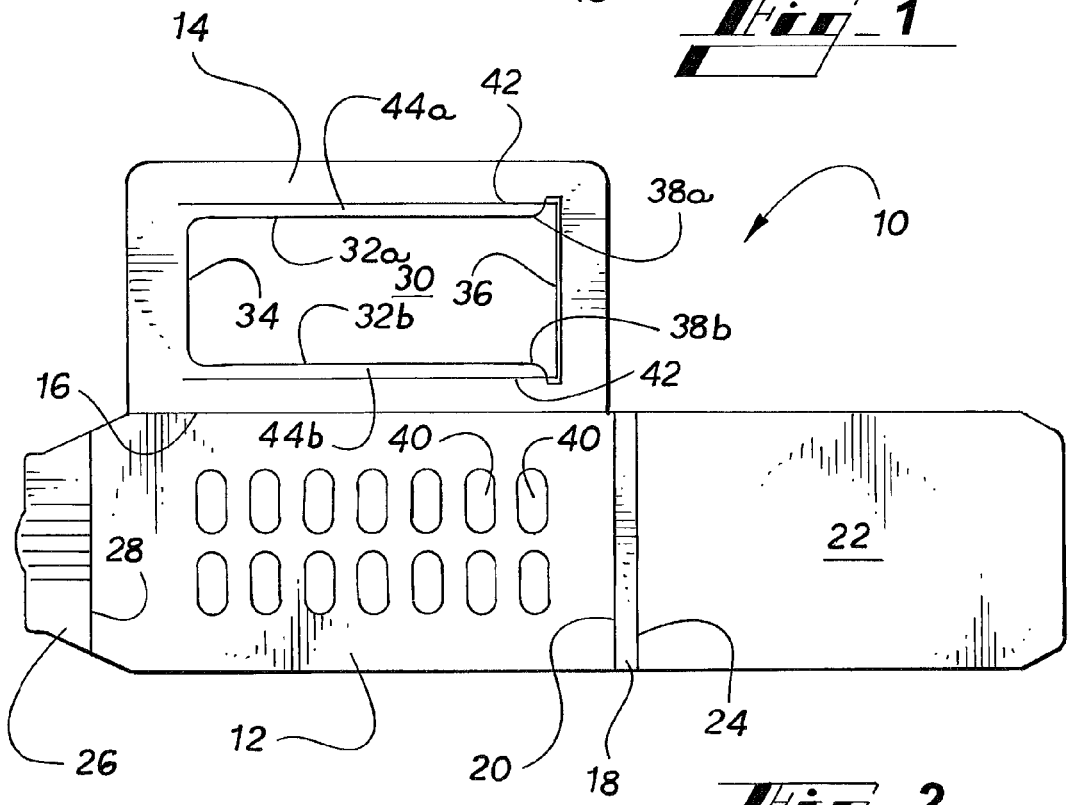
FIG. 2 is a plan view of a blank, according to an alternative embodiment of the present disclosure.

FIG. 2 illustrates an alternative embodiment of an exemplary blank 10 for forming a secondary package, in this case an inner slide card configured to receive a blister pack. The elements shown in FIG. 2 are similar to those shown in FIG. 1, the only difference being the orientation of some elements located on the top panel 14, which are, generally speaking, the mirror image of the same top panel elements shown in FIG. 1.

Figure 3A:
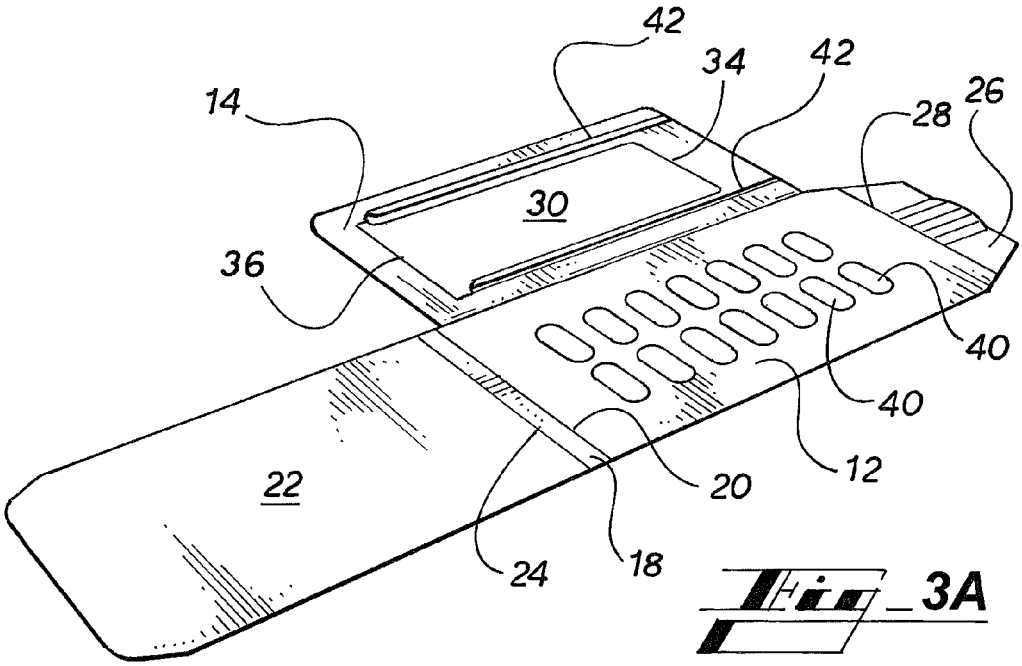
FIGS. 3A-3D are perspective views showing four stages of assembling an exemplary blank to form a secondary package.
Figure 3B:
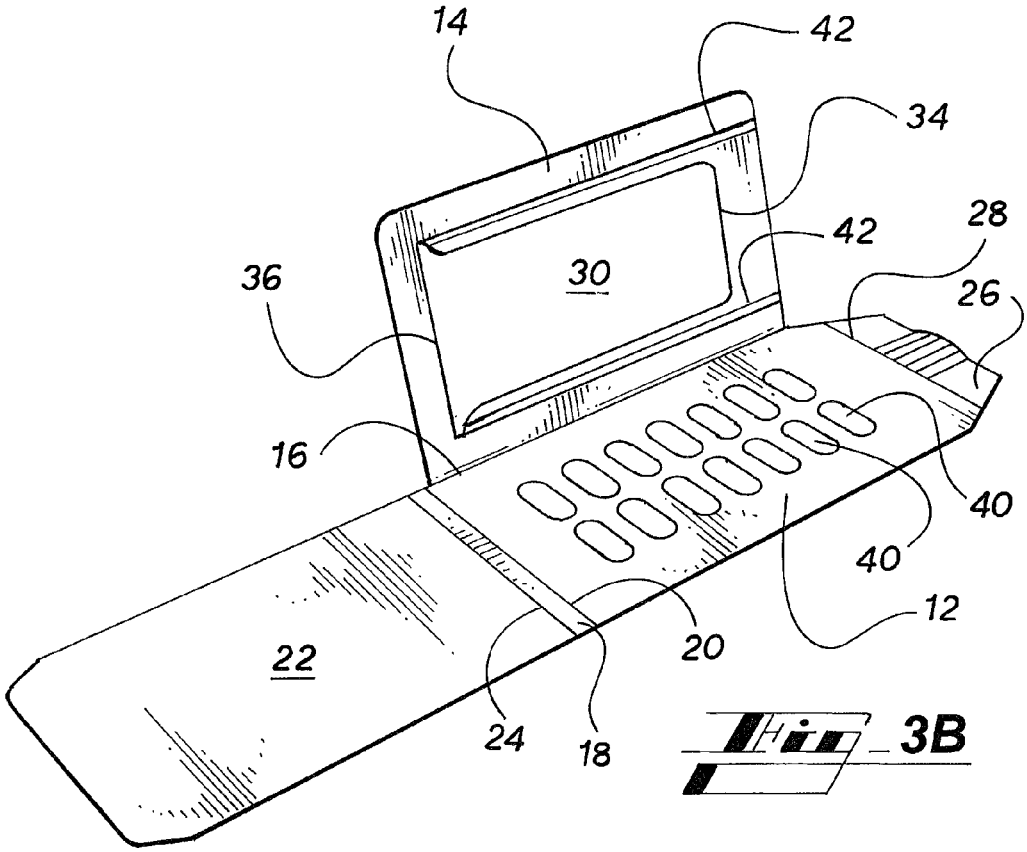

FIGS. 3A-3D are perspective views that collectively illustrate an exemplary method of folding and erecting the blank 10 to form a secondary package. Beginning with FIG. 3A, the blank 10 of FIG. 2 is illustrated in perspective, after the cutting and forming process is completed and after the illustrated means for connecting 42 is positioned on the top panel 14. The top panel 14 then can be folded along the fold line 16, as shown in FIG. 3B, such that the means for connecting 42 connect the top panel 14 to the base panel 12 in a face-contacting orientation. Notice here that the insert edge 36 is orientated toward the spine 18.

Figure 3C:
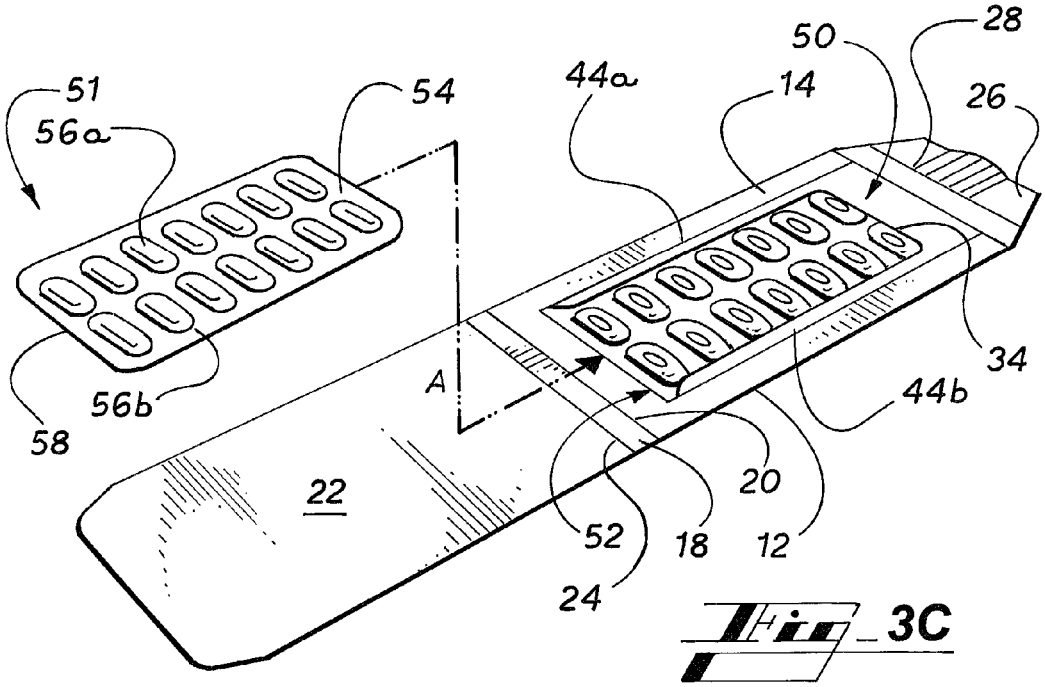

Turning now to FIG. 3C, a fully constructed but not yet fully erected secondary package is illustrated. The reader will understand that connecting the top panel 14 to the base panel 12 creates a blister pack receiving pocket 50, defined by the receiving flanges 44*a*, 44*b*, and the portions of material along the end edge 34 and insert edge 36 that are not attached to the base panel 12. After the blank has been erected to this point, the insert edge 36 can function as a pocket opening 52. FIG. 3C also shows a conventional blister pack 51, both before and after being loaded into the fully constructed secondary package. To load the blister pack 51 into the receiving pocket 50, the filler moves the blister pack leading edge 54 toward the pocket opening 52 in the direction of the arrow "A". More specifically, the filler slides the leading edge 54 over the insert edge 36 and under the radius cuts 38*a*, 38*b* to align and initiate the engaging of the blister pack side edges 56*a*, 56*b* with the receiving flanges 44*a*, 44*b*. Once the blister pack side edges 56*a*, 56*b* are correctly positioned under the radius cuts 38*a*, 38*b*, the filler fully inserts the blister pack 51 into the receiving pocket 50 by pushing the blister pack 51 until the side edges 56*a*, 56*b* are substantially completely inserted within the receiving flanges 44*a*, 44*b* and blister pack leading edge 54 passes under the receiving aperture end edge 34. The filler can then slide the blister pack trailing edge 58 back and under the insert edge 36, such that the entire perimeter of the blister pack 51 is captured between the top panel 14 and base panel 12. In various embodiments the blister packs may be loaded from the opposite end, such as when the top panel 14 is cut as illustrated in FIG. 1, and in various embodiments the blister pack may be further secured to the secondary package with additional means for connecting 42.

Figure 3D:
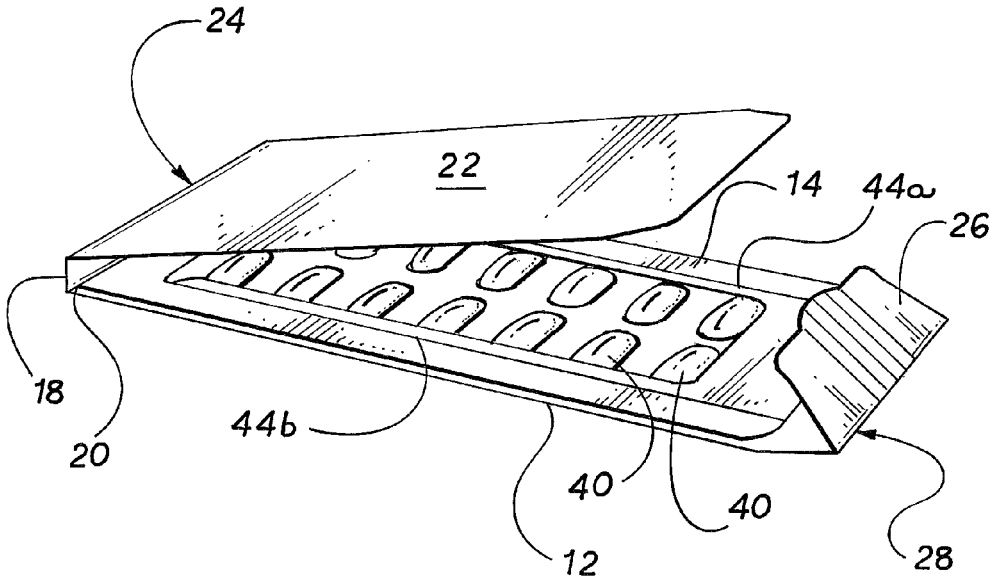

FIG. 3D shows the completion of the constructing and folding of the illustrated blank 10 of FIG. 3A, to erect a secondary package in the form of an inner slide card. After inserting the blister pack 51 in the receiving pocket 50, the spine 18 and cover panel 22 are folded along the respective fold lines 20, 24 so that the cover panel 22 is located over the blister pack 51 and is substantially parallel to the base panel 12. The locking panel 26 is likewise folded along its adjacent fold line 28, either upwardly as shown or downwardly—depending on the configuration of the outer sleeve that will receive the inner slide card.

For some applications the constructing and filling process illustrated by FIGS. 3A-3D is completed by a single party at one location, such as a manufacturer or filler. For other applications, the constructing steps shown in FIGS. 3A-3B are completed by one party at one location and the secondary package is then sent to a filler at another location who completes the filling steps shown in FIGS. 3C-3D. In shipping the constructed but empty blank between parties, it may be shipped flat as best shown in FIG. 3C or it may be shipped pre-folded as best shown in FIG. 3D.

Figure 4:
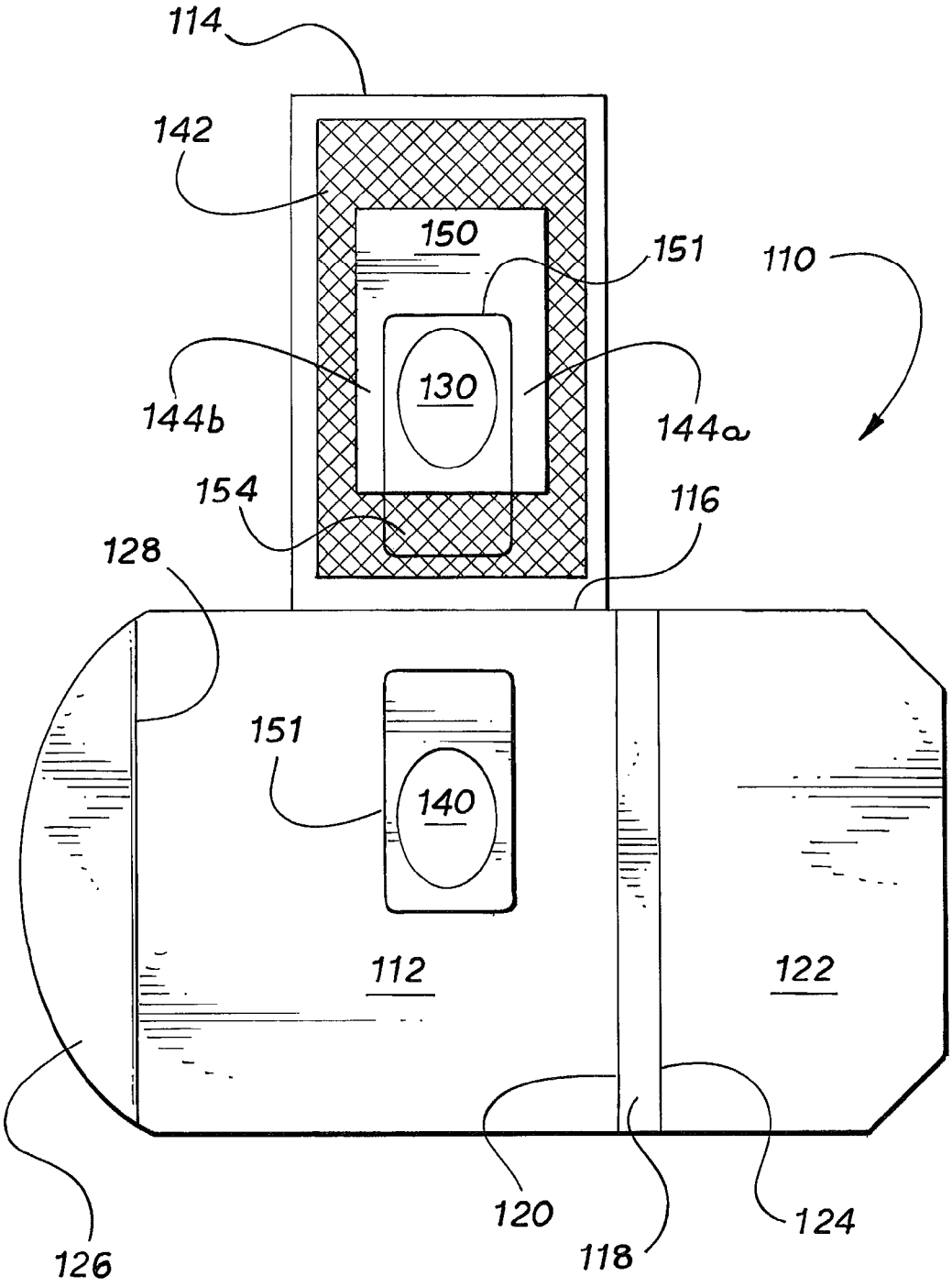
FIG. 4 is a plan view of a blank, according to another alternative embodiment of the present disclosure.

FIG. 4, another packaging blank, according to an alternative embodiment of the present disclosure, is illustrated. Where the elements introduced and described above are present and substantially similar in the elements present is this embodiment, the same element number has been used with the addition of the prefix "1". For example, the base panel 12 shown in FIG. 1 is substantially similar to the base panel 112 shown in FIG. 4. Accordingly, the elements shown in the exemplary embodiment illustrated in FIG. 4 will be introduced and only those features that warrant further discussion will be described.

Continuing with reference to FIG. 4, a blank 110 for an alternative secondary package includes a base panel 112. A top panel 114 is hingedly connected to the base panel 112 along fold line 116. A spine panel 118 is hingedly connected to the base panel 112 along fold line 120, and to a cover panel 122 along fold line 124. A locking panel 126 is hingedly connected to the base panel 112 along fold line 128. In an alternative embodiment, not illustrated here, the blank 110 for a secondary package does not include a locking panel 126. In yet another alternative embodiment, not illustrated here, the blank 110 for a secondary package does not include a locking panel 126, a cover panel 122, or a spine panel 118.

The top panel 114 further includes a blister pack receiving aperture 130. In the illustrated embodiment the receiving aperture 130 is substantially the same size as a gate 140 located on the base panel 112, and the two are operationally aligned when the top panel 114 is folded over and placed in face-contacting orientation with the base panel 112. In addition, means for connecting 142 is shown located on the top panel 114. One possible orientation of a blister pack 151 is also illustrated in FIG. 4.

In FIG. 4, the adhesive 142 is located on the inside face (the visible face) of the top panel 114, and is protected by a peelable backing such as is often found with an adhesive-backed label or double-face tape. Also, as illustrated in this embodiment, the means for connecting or means for securing 142 is located around the perimeter of the top panel 114 but not within the center of the top panel 114. That area—bounded by the adhesive 142 and where a majority of the blister pack 151 is positioned, forms receiving flanges 144*a*, 144*b* and a blister pack receiving pocket 150 when the blank 110 for the secondary package is constructed and erected.

In constructing and filling the illustrated embodiment, the peelable backing of the adhesive 142 is removed and a blister pack 151 is placed so that the blister protrudes through the blister aperture 130. In the illustrated embodiment, the blister pack leading edge 154 overlaps the adhesive 142, to further secure the blister pack 151. The top panel 114 is then folded to overlay and contact the base panel 112. The adhesive 142 then secures the top panel 114 to the base panel 112, thereby trapping the blister pack 151 along the receiving flanges 144*a*, 144*b* within the blister receiving pocket 150. The spine panel 118, the cover panel 122, and the locking panel 126 are then folded to erect the secondary package as described above.

The embodiments illustrated and described herein are directed to a secondary package that accommodates a single blister pack. In alternative embodiments, not illustrated here, the blanks are configured to hold more than one blister pack on the same or different combinations of top and base panels. In other embodiments, the blank is not a unitary blank but comprises individual blank portions.

The law does not require and it is economically prohibitive to illustrate and teach every possible embodiment of the present claims. Hence, the above-described embodiments are merely exemplary illustrations of implementations set forth for a clear understanding of the principles of the disclosure. Variations, modifications, and combinations may be made to the above-described embodiments without departing from the scope of the claims. All such variations, modifications, and combinations are included herein by the scope of this disclosure and the following claims.

What is claimed is:

1. A package for receiving and holding a blister pack, the package comprising:

a base panel having first and second opposed ends;

a top panel disposed in a face-contacting orientation with the base panel;

a spine panel hingedly connected to the first end of the base panel;

a cover panel hingedly connected to the spine panel to be disposed over the top panel, the cover and spine panels being hingedly movable into a deployed position where the cover and spine panels lie substantially in the same plane as the top and base panels; and a blister pack-receiving pocket defined at least by a receiving aperture in the top panel, wherein the receiving pocket has a pocket opening oriented toward the spine panel so that a blister pack is insertable into the receiving pocket through the pocket opening when the cover and spine panels are in the deployed position.

2. The package of claim 1, further comprising a locking panel hingedly connected to the second end of the base panel, wherein the receiving pocket is further defined by at least one receiving flange, the at least one receiving flange extending from the pocket opening toward the locking panel.

3. A package for receiving and holding a blister pack, the package comprising:

a base panel having first and second opposed ends;

a top panel disposed in a face-contacting orientation with the base panel;

a locking panel hingedly connected to the first end of the base panel, the locking panel being hingedly movable into a deployed position where the locking panel lies substantially in the same plane as the top and base panels;

a spine panel hingedly connected to the second end of the base panel, and a cover panel hingedly connected to the spine panel to be disposed over the top panel, and a blister pack-receiving pocket defined at least by a receiving aperture in the top panel, wherein the receiving pocket has a pocket opening oriented toward the locking panel so that a blister pack is insertable into the receiving pocket through the pocket opening when the locking panel is in the deployed position wherein the receiving pocket is further defined by at least one receiving flange, the at least one receiving flange extending from the pocket opening toward the spine panel.

* * * * *